US005186398A

United States Patent [19]

Vigneaux, Jr.

[11] Patent Number: 5,186,398

[45] Date of Patent: Feb. 16, 1993

[54] PAPER SHREDDER

[75] Inventor: Paul E. Vigneaux, Jr., 2214 Montgomery Ave., Woodbridge, Va. 22191

[73] Assignee: Paul E. Vigneaux, Jr., Woodbridge, Va.

[21] Appl. No.: 494,861

[22] Filed: Mar. 14, 1990

Related U.S. Application Data

[63] Continuation of Ser. No. 384,922, Jul. 26, 1989, abandoned, which is a continuation of Ser. No. 285,400, Dec. 16, 1988, abandoned, which is a continuation of Ser. No. 102,759, Sep. 24, 1987, abandoned, which is a continuation of Ser. No. 9,060, Jan. 29, 1987, abandoned, which is a continuation of Ser. No. 801,396, Nov. 25, 1985, abandoned, which is a continuation of Ser. No. 428,800, Sep. 30, 1982, abandoned.

[51] Int. Cl.[5] ..... B02C 18/06; B02C 23/18; B02C 25/00

[52] U.S. Cl. ..... 241/33; 241/36; 241/66; 241/101.2; 241/236; 184/6.1

[58] Field of Search ..... 241/33, 36, 101.2, 236, 241/66; 83/169; 184/6.1

[56] References Cited

U.S. PATENT DOCUMENTS 3,674,112 7/1972 Roberts ..... 184/6.1
3,785,456 1/1974 McIntire et al. ..... 184/6.1

FOREIGN PATENT DOCUMENTS 2061128 5/1981 United Kingdom ..... 241/236

OTHER PUBLICATIONS

"Operating Instructions for the Intimus 007", Revised Apr. 2, 1979; under FSC Group 36 Part II—Contract No. GS-OOS-03271 Period: Sep. 1, 1980 thru Jun. 30, 1981 (bound, w/attachments).
"Intimus 007-S Operating Instructions and Parts Manual", Jul. 14, 1980; Revised Mar. 22, 1982, Sep. 20, 1984, Feb. 1, 1985: (bound).
"GBC Shredmaster Model 400 Paper Shredder Parts & Service Manual", Dec. 1, 1979 (bound).
"Assembling and Operating Instructions EBA TA-510 Kombi", pp. 1-18 (undated).
Cummins-Allison Corp., "Federal Supply Schedule Price List" for period Jul. 1, 1981-Jun. 30, 1982, Item 51-125 1420 Shredder/Compactor (Contract No. GS-OOS-23411).
EBA Prazision TA 4-510 KOMBI Assembling and Operating Instructions (1980), Section E.
EBA Prazision TA 4-510 KOMBI Spare Parts Catalog (1982) p. S.

*Primary Examiner*—Joseph M. Gorski
*Attorney, Agent, or Firm*—Marc A. Miller

[57] ABSTRACT

This invention provides a method and a combination for automatically oiling a paper shredder with oil drops when it is running in the reverse direction, and after a predetermined running time in the forward direction.

15 Claims, 7 Drawing Sheets

(29) STOP (153)
137
139
163
165
151
155
159

141
150
(29) OIL-REVERSE (153)
143
145
17
19
OIL IN PROGRESS LIGHT

(29) STOP-LOCK-END OF CYCLE (153)
END OF CYCLE RESET LIGHT

PAPER SHREDDER

This application is a continuation of application Ser. No. 07/384,922 filed Jul. 26, 1989, and now abandoned, which is a continuation of application Ser. No. 07/285,400 filed Dec. 16, 1988 and now abandoned, which in turn is a continuation of application Ser. No. 07/102,759 filed Sep. 24, 1987 and now abandoned, which is a continuation of application Ser. No. 07/009,060 filed Jan. 29, 1987 and now abandoned, which in turn is a continuation of application Ser. No. 06/801,396 filed Nov. 25, 1985 and now abandoned, which in turn is a continuation of prior application Ser. No. 06/428,800 filed Sep. 30, 1982 and now abandoned.

BACKGROUND OF THE INVENTION

1. Field of the Invention

This invention relates to the field of paper shredders for quickly shredding large amounts of paper in an office environment to meet security requirements for classified, i.e., confidential, secret, top secret and communications security materials. To this end, shredders must shred at least from about 40–100 sheets of letter-size paper at a rate of one second per sheet to shreds of at least as small as 1/32"×½" shreds.

2. Description of the Prior Art

The field of commercial paper shredders is well established. One patent that is illustrative of this field is U.S. Pat. No. 4,034,918, which describes a pair of counterrotating shafts for mounting a series of spaced apart disc-type cutters. These shafts are driven by a reversible drive means having forward and reverse motions which are controlled by a suitable control means for intermittent operation. While oiling attachments for intermittently operated machines, such as presses, have been available as described in U.S. Pat. No. 1,246,886, these oiling attachments have been troublesome or inapplicable to commercial paper shredders.

It has now been found desirable to reduce the downtime and/or maintenance costs and/or to increase the longevity of paper shredders without increasing their cost, decreasing their efficiency or compromising their safety. Indeed, it is desirable to decrease their cost and/or increase their efficiency while maintaining or improving their safety.

One problem in improving the shredders known heretofore has been the nature of their cutting heads and their manufacture. They have been conventionally made by specialty companies from a large number of hard-to-manufacture, heavy-duty, cutting knives of expensive, high-quality, hardened steel. In a typical commercial cutter, 461 special steel, custom-made knives have been required to be made. Moreover, each knife has been as small as 1/35 inch thin×⅜ or ⅞ inch. Still further, the knives have been sharpened to provide knife-like edges and/or machined to have spiral grooves for ease in shredding every paper fed into the shredder in a failsafe manner. Additionally, these shredders have been required to quickly produce unreadably small particles that could not reasonably be reassembled into readable form. Thus for example, an ordinary paper shredder has been required to shred a letter-sized 8½" by 11" paper into at least 10,000 particles in a second. This has required the rapid rotation of these special steel knives at speeds up to 1000 RPM by large heavy duty motors and/or gears. This has caused a tendency for the knives to overheat and/or to dull repeatedly. It is additionally desirable to provide improved cleaning.

SUMMARY OF THE INVENTION

This invention provides a method and apparatus for intermittently dropping oil on the cutting heads of commercial paper shredders of the type described after they have run in a forward direction for a predetermined accumulated time. More particularly, this invention provides an improved combination for overcoming the problems of the prior art by intermittently dropping oil on cutting heads of these shredders known heretofore at predetermined frequent intervals of time in a predetermined sequence when the shredder is running in reverse. With the proper selection of accumulated times, intervals and sequences as described in more detail hereinafter, the desired goals are achieved.

In one embodiment, this invention provides the combination of an automatic, intermittent oil dropper having a sequencer for the reverse motion of a paper shredder in a cycle after a predetermined running time in the forward direction.

In one sequence, the forward motion of the shredder is stopped after a predetermined accumulated running time interval. Then the shredder motion is reversed and the cutting heads of the shredder are lubricated with oil drops for a predetermined time interval. Thereafter, the reverse motion is stopped for the beginning of another cycle. In this way the new cycle is begun safely in the forward direction; each cycle is repeated so as to include the desired lubricating interval at the desired time; the lubrication is made when the shredder is moving in the proper directions; the lubrication is accomplished after a predetermined accumulated running time interval in the proper direction; and the cutting heads or knives are properly and safely cleaned and stopped at the proper times. With the proper selection of times, intervals, sequences, directions and apparatus as described in more detail hereinafter, the desired lubrication and cleaning are achieved.

In one embodiment, the method of this invention comprises the steps of running the shredder in the forward direction for a first, predetermined accumulated running-time interval to shred paper; stopping the forward motion of the shredder, running the shredder in the reverse direction to clean the cutting heads while lubricating the cutting heads for a second predetermined time interval, and stopping the reverse motion of the shredder for the beginning of a new cycle in which the cutting heads are relubricated for a predetermined time interval corresponding to the second time interval in response to the running of the shredder for a time interval corresponding to the first time interval. With the proper selection of times, directions, cycles, intervals and lubrication as described in more detail hereinafter, the desired method is achieved.

It is also advantageous to provide appropriate safety means comprising indicator signals, interlocks and/or re-set means.

OBJECTS CF THE INVENTION

It is an object of the described invention to provide an improved shredder of the type described.

It is another object to provide an oiler for such a shredder.

It is another object to provide the combination of the shredder and an oil dropper for the cutting heads of the shredder when they are run in reverse.

It is another object to provide an automatic, intermittent oil dropper for the cutting heads of the paper shredder when they are run in reverse.

It is a still further object to provide an improved method and apparatus for running the shredder safely in a particular cycle having a predetermined oiling and accumulated running time sequence.

BRIEF DESCRIPTION OF THE DRAWINGS

In the Figures where like elements are referenced alike.

DETAILED DESCRIPTION OF A PREFERRED EMBODIMENT

This invention is useful with a rotary shredder for waste materials having a pair of counterrotating shafts, each of which has a series of spaced apart disc-type cutters. More particularly, this invention relates to, and is useful with, paper shredders for quickly shredding large amounts of paper in a trouble-free manner in an office environment to meet security requirements for classified, i.e., confidential, secret, top secret and communications security materials. To this end, these particular shredders must shred an $8\frac{1}{2}'' \times 11''$ letter-size paper sheet at a rate of 1 second per sheet to shreds of at least as small as $1/32'' \times \frac{1}{2}''$ shreds, which amounts to about at least 10,000 separate shreds. Thus, this invention is particularly useful with the Intimus Model 007-S shredder made by DataTech, which is available from Whittaker Brothers Business Machines, Inc., 5913 Georgia Ave., N.W., Washington, D.C. 20011. For ease of explanation, this invention will be described in connection with such a particular shredder. However, it will be understood that this invention is likewise useful with CBC Shredmaster shredders such as the Shredmaster Conveyor 400 Series, which is available from CBC Shredmaster, 2030 West McNabb Road, Ft. Lauderdale, Fla. 33309.

Moreover, this invention is useful with other like shredders which are well-known in the art.

Figure 1:
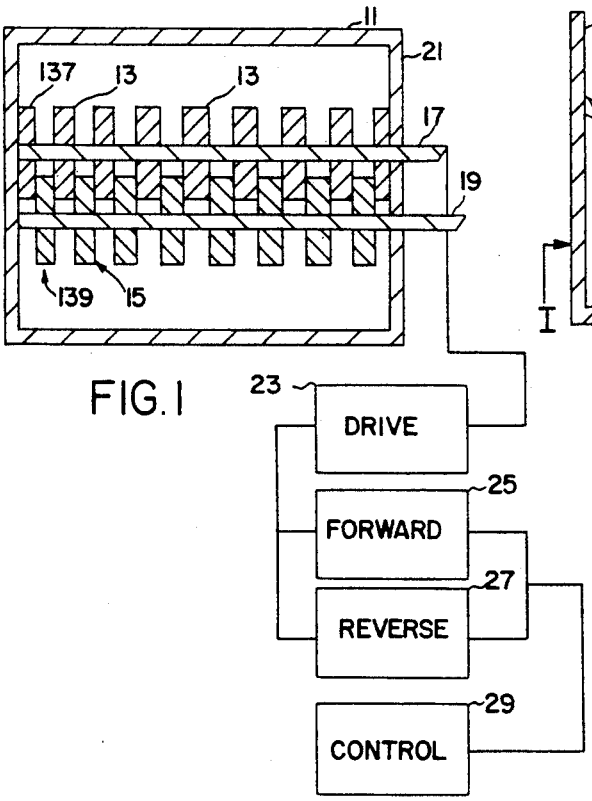
FIG. 1 is a partial cross-section of the cutting heads of a conventional commercial paper shredder of the type described.
Figure 2:
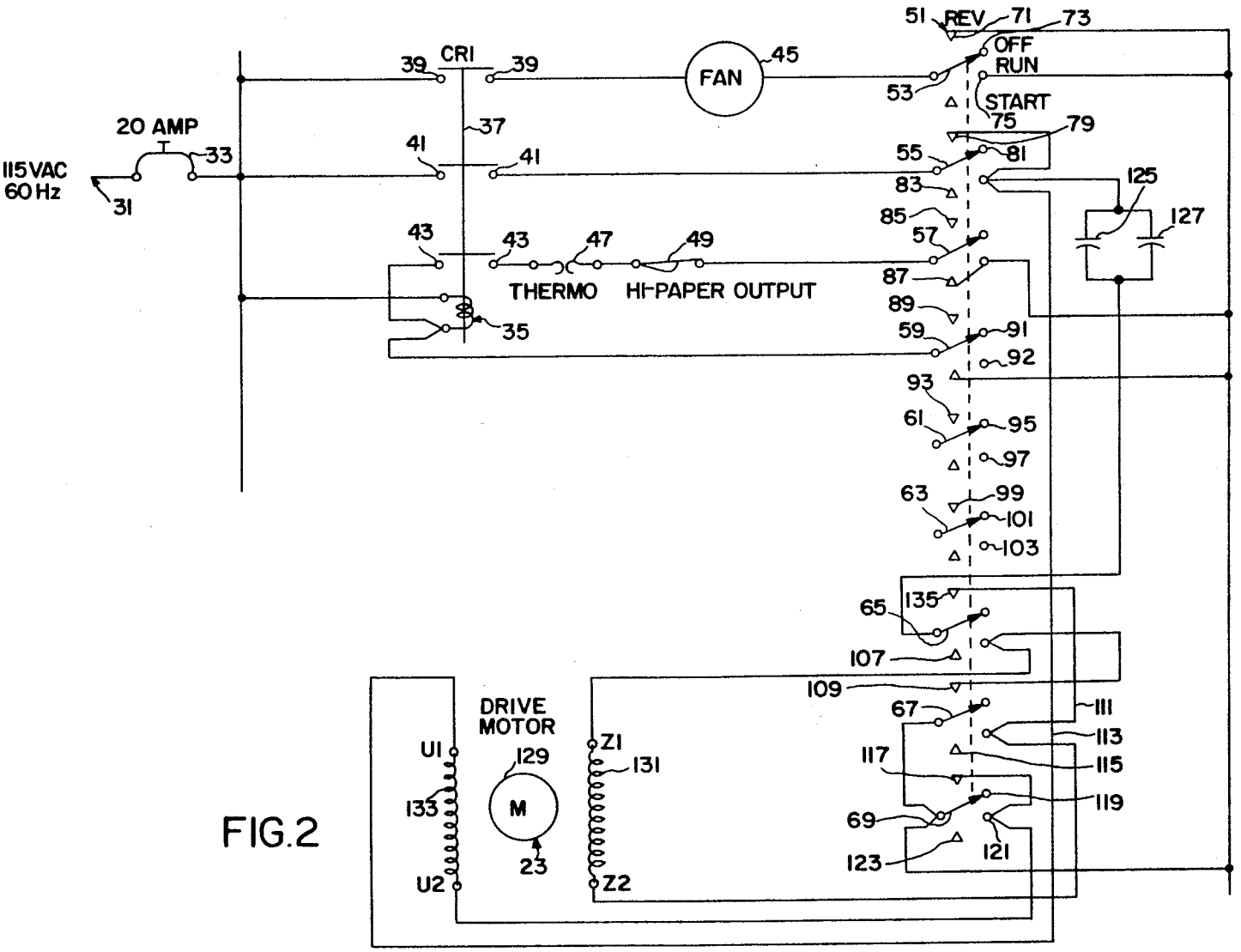
FIG. 2 is a partial schematic drawing of the control for intermittently running the cutting heads of FIG. 1 in the forward and reverse directions.

Referring now to FIG. 1, this particular kind of shredder 11 is shown. The main elements of this particular kind of shredder 11 are illustrated in FIGS. 1 and 2. To this end, it will be understood that this particular paper shredder 11 has such elements as cutting heads 13 and 15, having shafts 17 and 19, respectively, a housing 21 and a drive 23. As is conventional, the drive 23 has a means 25 for causing the drive to rotate in the forward direction and a means 27 for making the drive rotate in the reverse direction. Likewise, it will be understood that the drive and the system for making it rotate the cutting heads on shafts 17 and 19 in the forward and reverse directions is under the control of a control 29, such as is illustrated schematically in FIG. 1.

As is shown in FIG. 2, the shredder 11 of FIG. 1 has a suitable circuit 31 forming a power source. Such a power source may include a 115-volt AC 60 Hz power supply as is illustrated in FIG. 2. Also such a circuit has a 20 amp fuse 33. As is typical, a CR1 switch is provided by a relay 35 having an armature 37 and contacts 39, 41 and 43. Associated with this relay are other conventional elements comprising a fan 45, a thermal switch 47, a high paper cut-out switch 49 and a four-position switch 51. The latter switch has armatures 53 through 69 and contacts 71 through 123. Also condensors 125 and 127 are provided as is conventional in circuits for changing the phase of an AC drive motor 129 having coils 131 and 133. Thus when the four-position switch 51 is switched to the run position illustrated in FIG. 2, the motor is first actuated by switch 51 in the start position. This kind of a switch is typical for intermittently run motors for shredders like shredder 11. Such : switch 51 is also useful in intermittently reversing the motor 129 for reversing the direction of the cutting heads and cutters, as will be understood in more detail hereinafter.

Figure 3:
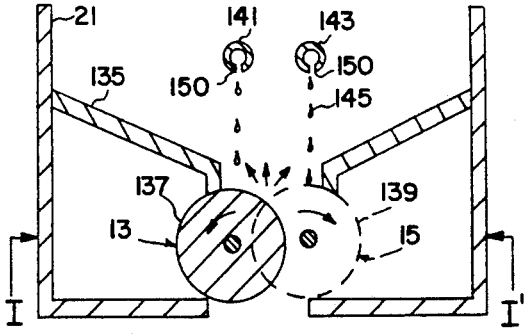
FIG. 3 is a partial cross-section of the cutting heads of FIG. 1 with the oiling apparatus of this invention added thereto.

Should the cutting heads 13 and 15 have oil drops dropped thereon intermittently after the cutting heads have run in a forward direction for a predetermined accumulated time in accordance with this invention, this invention has the advantage of providing an improved combination for overcoming the problems of the prior art. To this end, the apparatus shown in FIG. 3 provides an apparatus for dropping oil on the cutting heads when they are rotating in the reverse direction, as illustrated in FIG. 3. Moreover, as will be understood in more detail hereinafter, the apparatus of FIG. 3 intermittently drops oil on the cutting heads of the shredder 11 of FIG. 1 at predetermined frequent intervals of time in a predetermined sequence. Thus, in one sequence which is illustrated hereinafter in connection with FIGS. 4 and 5, paper is fed into chute 135 so that knives 137 and 139 on the respective cutting heads 13 and 15 cut the paper into the desired small shreds. Thereafter, oil pipes 141 and 143 drop oil drops 145 onto the knives 137 and 139 when they are rotating in the reverse direction. This is at a time interval after the cutting heads have run in the forward direction for a predetermined accumulated time for cutting paper, as will be understood in more detail hereinafter.

Figure 4:
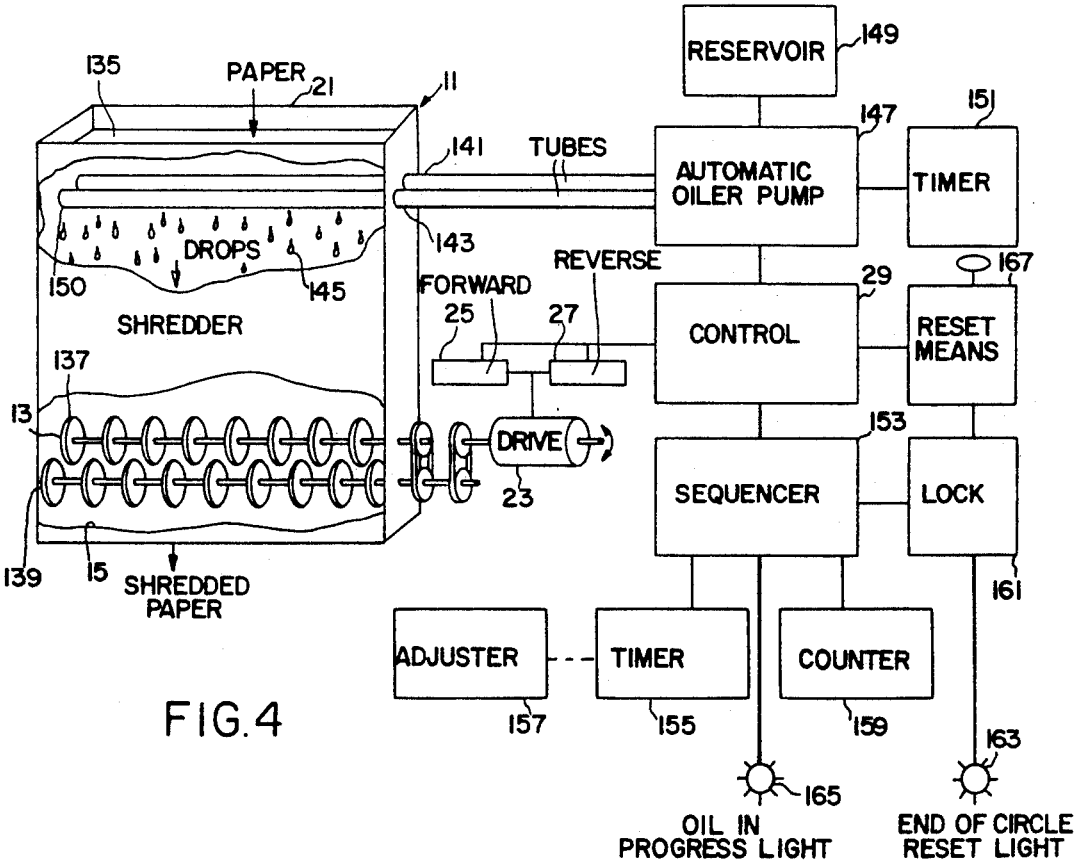
FIG. 4 is a partial schematic view of one embodiment of the control system for the oiling apparatus of FIG. 3.

Referring now to FIG. 4, which shows the main elements of the combination of this invention, there will be seen an oil pump 147 and an oil reservoir 149 for dropping oil drops 145 onto the cutting heads 13 and 15 and the knives 137 and 139 thereof. As illustrated in FIGS. 3 and 4, in one embodiment, two oil pipes 141 and 143 are provided in line with the axis of the cutting heads 13 and 15. Thus when the automatic oil pump 147 causes oil to be forced through the oil pipes 141 and 143 in response to a command from control 29, the oil from reservoir 149 is forced out of holes 150 in the bottom of the pipes and falls directly onto the top of the knives 137 and 139. This automatic oiling, which is controlled by control 29, takes place for a short interval which is determined by timer 151. Moreover, this automatic oiling takes place on a command from sequencer 153 so that the oiling only takes place when the control 29 causes the drive 23 to rotate the knives 137 and 139 in reverse as understood from the reverse mechanism illustrated in FIG. 4.

Timer 155 causes the sequencer and control to actuate the automatic oiler pump 147 after the shredder 11 is run in the forward direction for a predetermined accumulated time interval set by timer 155. This time interval may be adjusted by adjuster 157. Moreover, the completed cycles are counted by counter 159. Also lock 161 causes the drive to come to a halt and be locked until the beginning of the new cycle as understood in more detail hereinafter. Still further, light 163 indicates the end of a cycle, whereas light 165 indicates that the oiling is in progress. Re-set 167 allows the beginning of a new cycle.

Figure 5A:
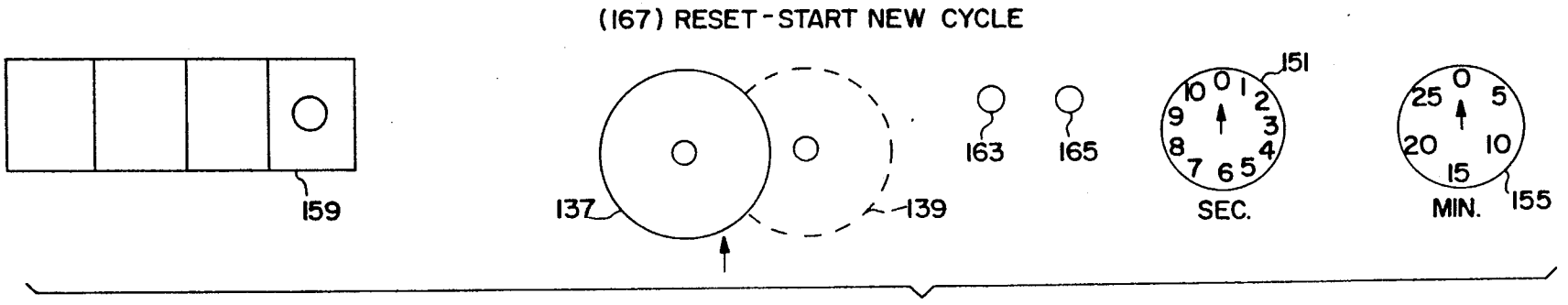
FIG. 5*a* through 5*e* are partial schematic illustrations of one cycle for safely sequencing the oiling apparatus of this invention with the control system of FIG. 4.
Figure 5B:
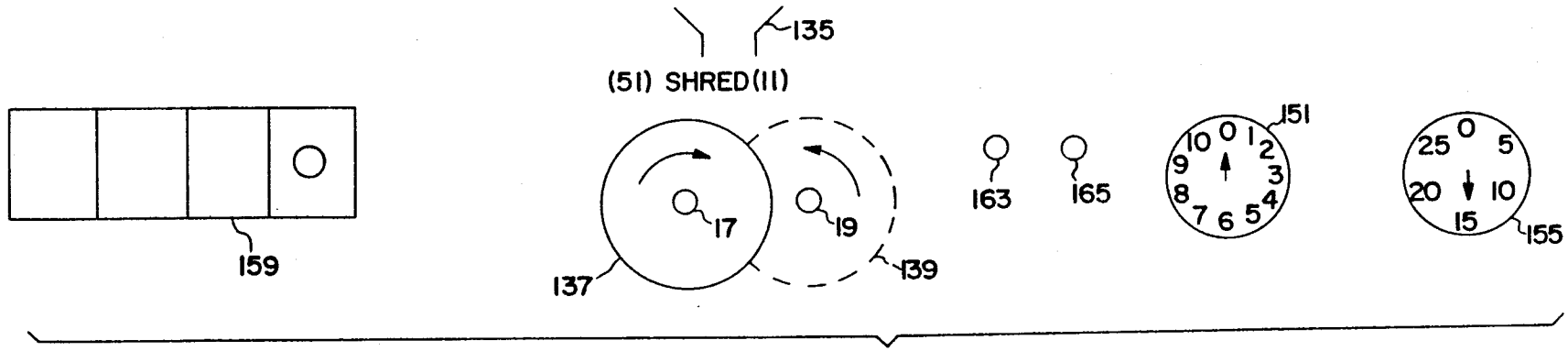
Figures 5C, 5D, 5E:
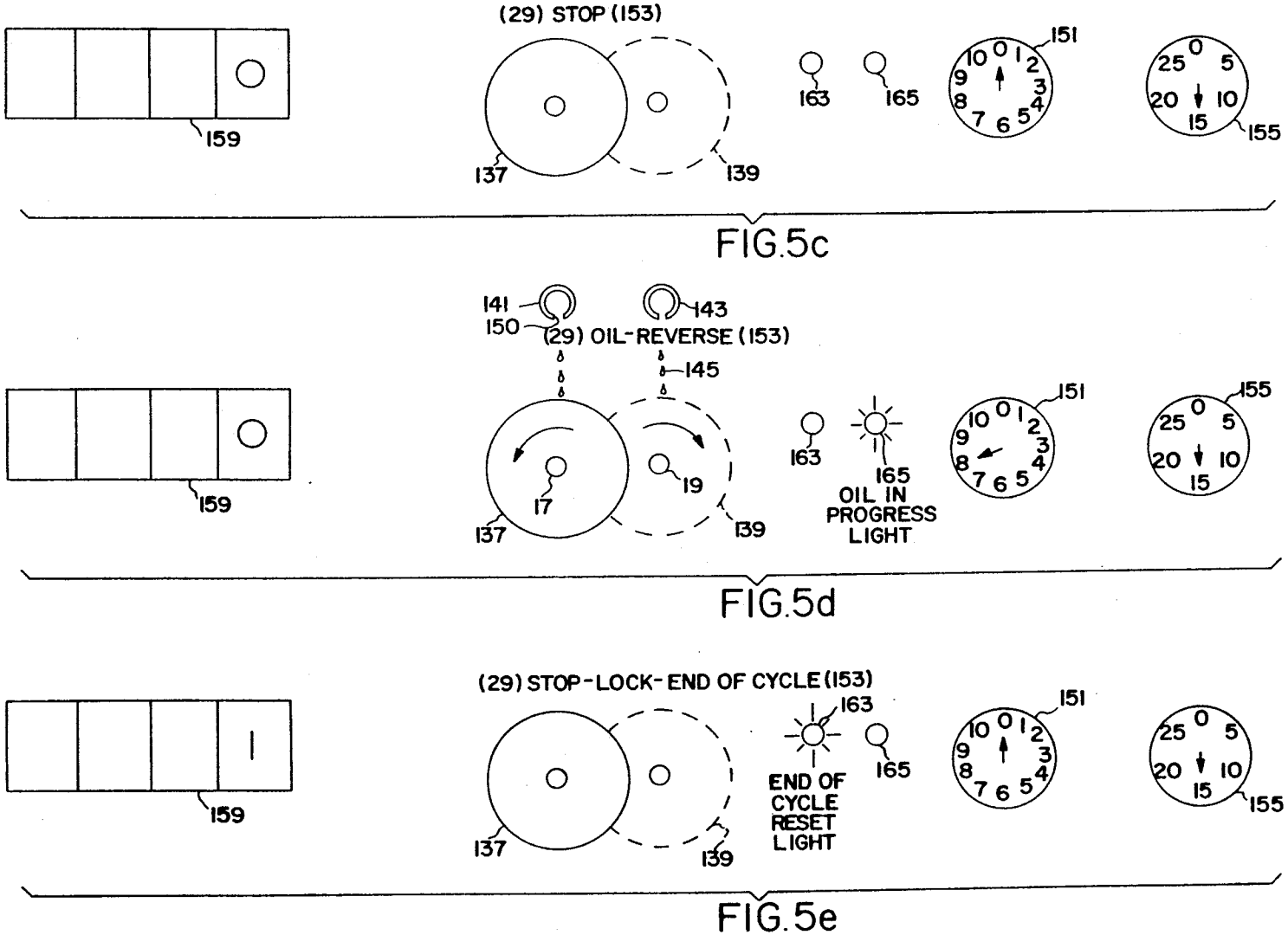

Referring now to FIGS. 5*a*–5*e*, there is illustrated the sequence for intermittently dropping oil on the cutting heads of the shredder 11 of FIGS. 1, 3 and 4. To this end, as illustrated in FIG. 5*a*, after the re-set 167 is depressed, a new cycle may begin. At this time, the counter 159 illustrates the number of cycles that have been completed. In FIG. 5*a*, which is only illustrative, nc cycles have been completed. Thus, the counter 159 shows zero cycles having been completed. Likewise, knives 137 and 139 are motionless and the end of cycle re-set light 163 and the oil and progress light 165 are not lit. Still further, it will be understood that the oil timer 151 is illustrated as being set at a zero position for the beginning of a new oiling cycle. Also, timer 155 is illustrated as being ready to begin the timing of the new accumulated time interval for the shredder 11 before the oil timer is actuated to cause the automatic oiling of the knives 137 and 139 as illustrated in FIGS. 5*d*, 3 and 4.

As illustrated in FIG. 5*b*, switch 51 is positioned to start the shredder 11 in the forward direction. As illustrated, the knives are rotating in respective opposite directions to cause the paper from chute 135 to fall into the blade knives 137 and 139 so that the paper is drawn into the blades and shredded thereby. At this time in the sequence, the end of cycle re-set light 163 and the oil and progress light 165 are still not lit. Also the counter 159 still indicates that no cycle has been completed. Likewise the clock illustrated in FIG. 5*b*, which illustrates the time interval for the oiling sequence has not been actuated. Thus, the timer 151 still remains in its zero position. However, the timer 155 is running. This timer 155 runs until a predetermined accumulated time interval is obtained. Thus, for example, after the shredder 11 has been actuated to rotate the knives 137 and 139 in the forward direction for fifteen minutes, the control 29 is actuated by sequencer 153 to bring the knives 137 and 139 to a complete stop.

This portion of the sequence is illustrated in FIG. 5*c*. It is noted that the counter 159 still indicates that no cycle has been completed. Thus the counter still reads zero. Likewise, the lights 163 and 165 are still not lit. Still further, the oiler clock 151 is still in its zero position. However, the accumulated running timer 155 is still in its same position at the end of one accumulated time interval as shown in FIG. 5*b*. Thus, the clock of FIG. 5*c* is in the position indicated, which typically is in a position indicating that the shredder 11 has run for an accumulated time of 15 minutes even though the shredder has been run intermittently one or more times during this fifteen minute interval.

Referring now to FIG. 5*d*, the control 29 and the sequencer 153 actuate the drive 23 and the shafts 17 and 19 to rotate the knives 137 and 139 in the reverse direction illustrated in FIG. 5*d*. Thus the knives are rotating in the respective directions illustrated, which is a direction in which the paper fed into the chute 135 would not be shredded. Thus the oil and progress light 165 is illuminated to indicate to the operator that the shredder is running in its reverse direction, at which time the knives 137 and 139 are being oiled. As will be understood from FIG. 3, this causes the oil to cling to the surface of the knives until they have completed at least one revolution, at which time the oil particles are spun up and around the surfaces of the knives. This causes the complete surface of both knives to be oiled around their entire circumference. At this time, the end of cycle light 163 is still not lit. Also the timer 155 is still in its same position shown in FIGS. 5*b* and 5*c*, i.e., at the end of an accumulated running time interval of about fifteen minutes. However, the timer 151 for the automatic oiler connected to the tubes 141 and 143 causes them to drop oil drops 145 onto the surface of the knives 137 and 139 through holes 150 for the period of time set by the timer 151. As illustrated in FIG. 5*d*, this period is typically about eight seconds.

Following the oil sequence illustrated in FIG. 5*d*, the controller 29 and the sequencer 153 cause the reverse rotation of knives 137 and 139 to completely come to a stop. This is illustrated in FIG. 5*e*, which shows the end of the cycle. Thus, the counter 159 shows the number 1 to indicate to the operator that one cycle has been completed. Thus the end of cycle re-set light 163 is lit and the oil and progress light 165 is not lit. Meanwhile, the timer 151 illustrated in FIG. 5*e* shows that the eight second oiling interval has been completed and the oiling timer has been returned to its original zero position. However, the timer 155 for the shredder 11 still shows the fifteen minute accumulated time interval shown in FIGS. 5*b*–5*d*. This time interval is only re-set to zero, in the sequence illustrated in FIGS. 5*a*–5*e*, after the re-set button 167 is depressed to start a new cycle. As will be understood in more detail hereinafter, this cycle may be changed to some extent by varying the circuit elements.

Figure 6:
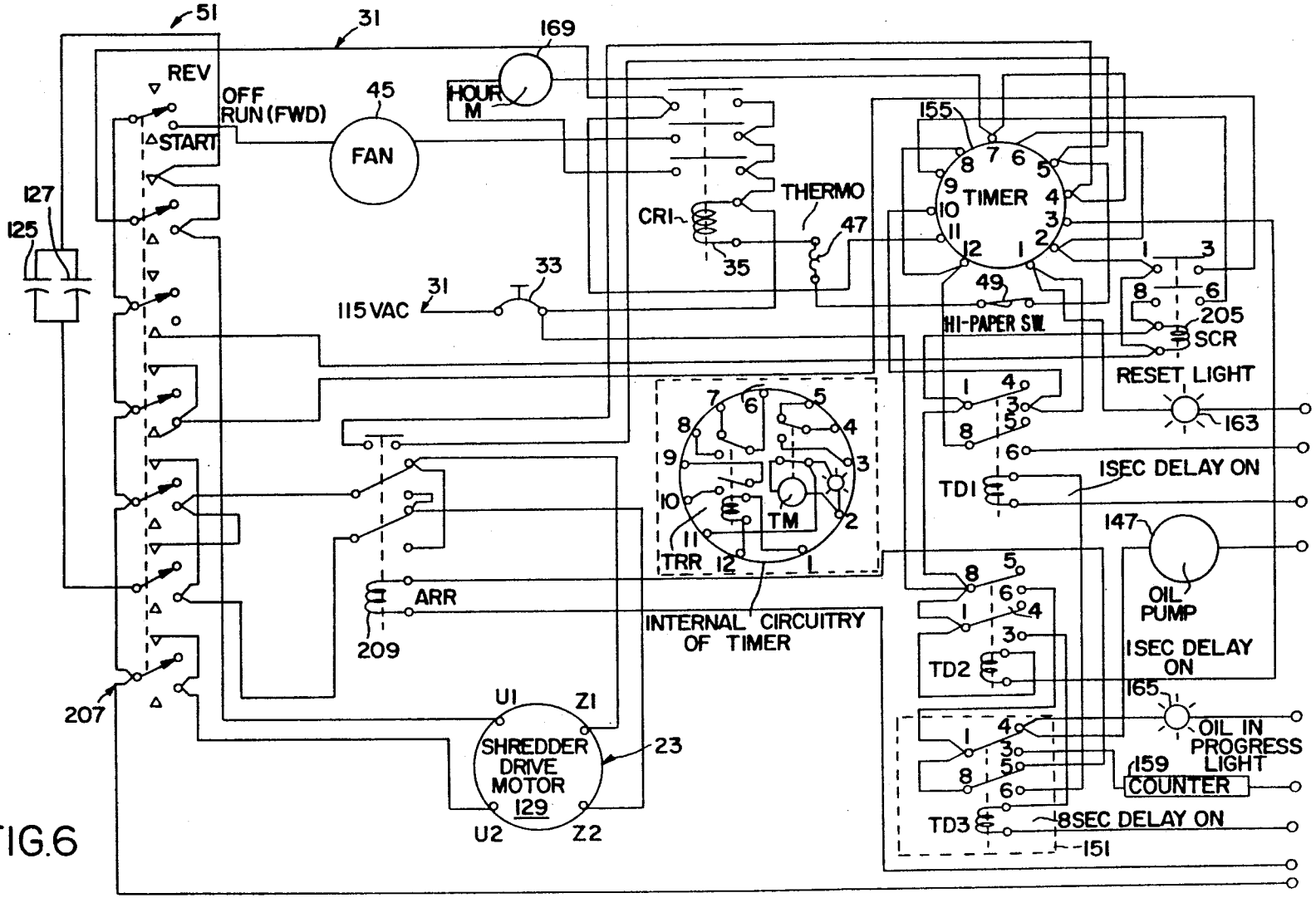
FIG. 6 is a partial schematic illustration of one circuit for providing the sequence in the cycle illustrated in FIG. 4.

Referring now to FIG. 6 for one embodiment of a circuit 31 for providing the desired cycle and sequence for the shredder 11 of FIGS. 1, 3 and 4, it will be understood that an AC drive motor 129 is provided for the drive 23. In this connection, it will be understood that the basic elements of FIG. 2 have been modified as shown in FIG. 6. To this end, for example, suitable timers have been added such as the timer 155 which functions to provide suitable timing as illustrated by the timer 155 of FIG. 4. As will be understood in more detail hereinafter, this specific timer 155 is shown in more detail in FIG. 7.

Advantageously for one cycle, the timer is set to time the accumulation of fifteen minutes of actual shred run time. In this connection, the shredder 11 is an electrically driven, gear operated device that retains elapsed time once registered by the specific timer 155. The return to zero time base is accomplished through energization of its internal re-set relay TD, as will be understood in more detail hereinafter.

The unit is wired through an internal microswitch or switches to transfer the external control circuits to the appropriate places. An additional microswitch transfers simultaneously with the control circuit microcircuit to insure power removal from the timing motor when a predetermined elapsed time has been reached.

Advantageously stock relays are used which are "slow to operate". Moreover, all the relays are adjustable. Suitable adjustment delays are from zero to ten seconds, respectively. The counter 159 is advantageously a 120 volt pulse type counter which advances on the application of power. The hour meter 169 may optionally be employed. In this case, it is a 120 volt device that accumulates time whenever power is applied. Also advantageously there is provided an automatic reverse relay ARR. This comprises a 25 amp, 120-vac coil with an SPDT microswitch operated mechanically by energization of relay armatures and is typically understood as being a DPDT automatic reverse relay. Likewise, the visual indicator lights are 120-vac lamps and the start control relay is indicated as an SCR, which is also referred to as a DPDT, 10 amp, 120-vac relay which is energized upon the application of power.

The oil pump is a 120-vac motor-driven pump. It may specify a wide variety of pressures and gallonages which are required to produce the desired oil droplets 145 from the holes 150 in pipes 141 and 143.

In the cycle illustrated in FIGS. *5a–5e*, it will be understood that the switch 51 is initially in its off, no power to any portion of the shredder 11, position. When the switch 51 is put into its start position, it provides a spring loaded momentary position. This allows the control relay CR-1 to pick-up (energize), releasing the switch and allowing the spring loading to establish a hold in the circuit for CR-1 in order to place the switch 51 in its run position. The run position of switch 51 allows the shredder 11 to rotate in the forward motion direction illustrated in FIG. *5b*, when shredding of paper materials may be accomplished. The switch 51 has a spring-loaded reverse position that causes the knives 137 and 139 to run in reverse mode to purge waste materials from the cutting heads when the switch 51 is held in this position. The drive motor 129 is a single phase 120-vac, 60 Hz, 1½ horsepower reversible unit whose direction is controlled by two parallel large electrolytic MFD condensors 125 and 127 that cause the phase shift that is induced into the motor windings 131 and 133, which are illustrated for ease of explanation in FIG. 2. This causes the motor windings to be energized in the desired direction which is defined by the position of the control switch 51 to produce either the desired forward or reverse direction of movement. In FIG. 1, this forward-reverse control is illustrated by means 25 and 27 under the command of control 29. Thus, a different circuit is used for a DC motor as will be understood in more detail hereinafter. In both cases, it will be understood that a small fractional horsepower fan 45 is provided which is likewise powered by the CR-1 relay 35 to afford cooling of the cutting heads 13 and 15 during operation.

Any time control switch 51 is placed in its start position, a circuit 31 for energizing the control relay 35 is completed through normally closed contacts of the SPDT microswitch of the timer 155 through a normally closed set of contacts of the timer's internal re-set relay 203 to a normally opened set of contacts of the start relay (SCR) 205. This start relay 205 is likewise energized when the control switch 51 is placed in its start position. Upon its energization, the start relay 205, which has normally open contacts, closes and provides a hold in the circuit for the start relay 205 and finally completes the circuit to neutral for energization of the CR-1 relay 35. This allows power to be applied to the cooling fan 45, phase shift capacitors 125 and 127, the directional control switch to switch portion 207 of switch 51, which is connected to the drive motor 129 and to the timer motor 201 through the timer's internal SPST microswitch. The auxiliary contacts of the CR-1 relay 35 close providing power to the hour meter 169 which completes its circuit through the normally closed contacts of the timer re-set relay 205 (TRR). This release of the control switch from its spring-loaded start position allows it to assume the run position, whereupon the above sequence is locked in and the shredder 11 operation continues.

The shredder 11 continues to run in the forward direction while its run time is simultaneously accumulated on the timer itself. This places the control switch to the off position, which opens the neutral circuit for all control devices and the machine operation is stopped. However, all time accrued during each run mode is retained on the timer 155.

Reverse operation is exactly the same as the run position (forward) except that the power is applied to the drive motor winding in a different direction through the action of the control switch 51.

Upon accumulation of the predetermined elapsed time of the machine operation, the timer 155 mechanically activates its internal switching, comprising the SPDT microswitch, which breaks the circuit for the CR-1 relay 35 and completes the circuit for the TD-2 relay. The TD-2 relay receives power to its coil through a normally closed contact of the TD-3 relay. This opens the CR-1 relay switch to stop the machine operation. After a pause of one second, the TD-2 relay energizes the set of TD-2 contacts to close them. This provides power to the automatic reverse relay (ARR), which has a coil 209 which immediately energizes. The same TD-2 contacts provided power across the normally closed set of contacts of the TD-3 relay and begins the oil pump motor operation. This also eliminates the oil and progress light 165. A second set of contacts of the TD-2 relay are simultaneously closed supplying power to the coil of the TD-3 relay. The TD-3 relay sees this power for eight seconds before it is energized due to an internal delay which is conventional in such relays. When the ARR relay coil 209 is energized, its two main contacts close providing a circuit for the drive motor that will allow the motor to run in reverse. Also, an auxiliary microswitch on the ARR relay coil 209 is closed by actuation of its armature. This closing of the microswitch provides a complete circuit for the CR-1 relay 35, and it re-energizes. The cooling fan is once again operated and power is again applied to the drive motor 129 which rotates in reverse due to the switching of power through the action of the ARR contacts of the relay coil 209.

During this mode, the second microswitch in the timer 155 has also transferred, isolating the timer motor from its power supply. This prevents it from operating. However, total machine running time accumulated for overall record purposes is provided any time the CR-1 relay 35 is energized.

The drive motor 129 continues to run in reverse while the oil pump is delivering oil to its manifold, which allows even lubrication to be applied to the cutting heads 13 and 15 to wet their entire surfaces with oil. After the lubrication time is up, the TD-3 relay energizes. A set of normally closed TD-3 contacts open, breaking the power to the TD-2 relay. A second set of normally closed TD-3 contacts open, stopping the oil pump operation and extinguishing the oil light. Another set of TD-3 normally closed contacts open, removing power from the TD-1 relay and, finally, a set of normally open TD-3 contacts close, placing power to the counter 159. Upon interruption of the power to the TD-2 relay, it de-energizes, removing power from the ARR coil 209 and the TD-3 relay. This de-energizing of the ARR relay coil 209 opens its auxiliary microswitch breaking the hold circuit for the CR-1 relay 35 and it drops out.

Figure 7:
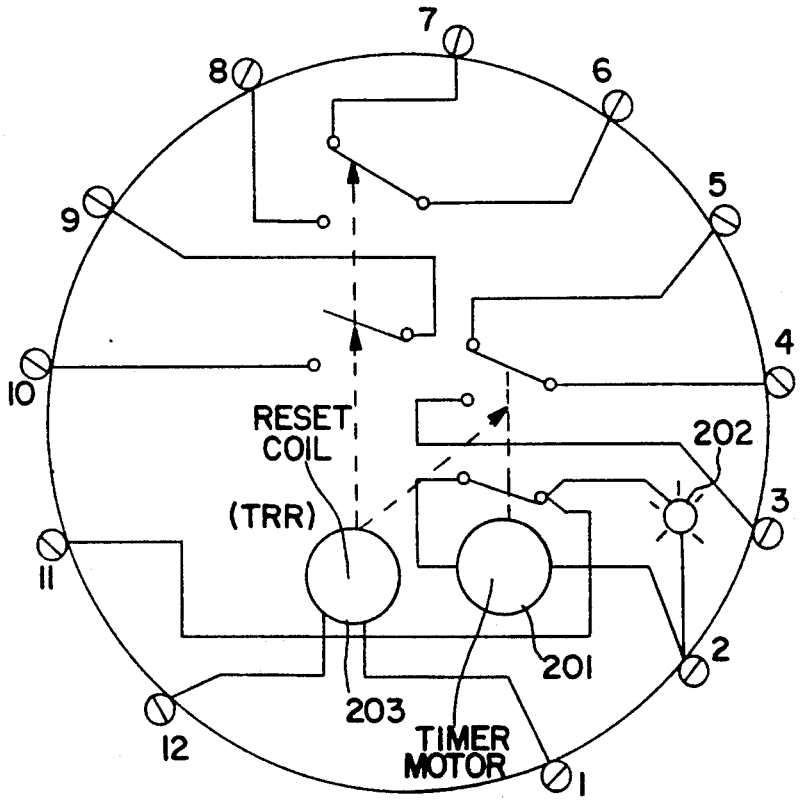
FIG. 7 is ar expanded view of a portion of the timer of the sequencer of FIG. 6.

The ARR relay coil 209, which drops out, is now in the relaxed state ready to provide forward rotation again when the CR-1 relay 35 is commanded to re-energize. De-energizing the TD-3 relay causes a normally closed set of its contacts to reclose, applying power to the coil of the TD-1 relay. The TD-1 relay has a delay of one second before it re-energizes. While in the de-energized position, the TD-1 relay allows two sets of normally closed contacts to direct power to the TRR re-set coil 203, which is shown in FIG. 7. This energizes the re-set relay coil 203 which, upon closing, causes an immediate mechanical reset of the timer mechanism. This repositions the timer to zero and recloses its two microswitches. This readies this portion of the circuit for initiation of a new timing cycle. However, to prevent CR-1 relay 35 from pulling at this time interval, a set of normally closed TRR contacts in relay coil 203 open to prevent the CR-1 relay coil 35 from picking up. Two other normally open TRR contacts of relay coil 203, in effect, lock the system out. This necessitates a manual re-set of the selector switch 51 to resume normal shredding operations. Re-set is accomplished by placing the selector switch in :e-set. This holds the contact for the TRR relay coil 203 momentarily so that the contacts are momentarily open. Then the TRR coil 203 drops out, which will allow the CR-1 relay 35 to re-energize through the now-relaxed, normally closed contacts of the TRR relay 203.

Advantageously the timer 155 is a Cycle-Flex timer, Part. No. HP5-1-A6-01, manufactured by the Eagle Signal Industrial Company, Davenport, Iowa. This Cycle-Flex brand re-set timer, HP5 series, is used commercially whereever a timed period is to be initiated by an external signal from a push-button, limit switch, photocell Thus, one Cycle-Flex may be used to time a single interval, such as running the shredder 11 for a preset time. Moreover, the Cycle-Flex brand plug-in feature reduces machine down-time by providing instant removal for checking or replacement. The timing settings are made by turning a knob on the front of a large, easy-to-read dial. Also, a neon pilot lamp glows red when the timer motor is energized. Additional visual indication is provided by a red cycle progress pointer, which advances clockwise from the setting back to zero as timing progresses. The SPDT delay switch, which has been described, is tripped when this pointer reaches "zero". Two instantaneous contacts and two delayed contacts provide circuit combinations for any control requirement.

The time delay relay TD-3, which is referred to as timer 151, is an 0–10 second delay relay which operates on 115 volts AC. A suitable time delay relay 151 is made by W.W. Grainger, Part No. 5X828, Dayton, Ohio.

The hour meter 169 is an elapsed time indicator, also made by Grainger, Part No. 6X144. The counter 159 is an impulse counter which is normally not re-set. It is a 115 volt AC counter also made by Grainger, Part No. 6X163, Manufacturer No. 2-1525-115AC. The DPDT delay has a 10 amp contact. It is also made by W.W. Grainger, Part No. 5X827. The base relay socket is an 1110 octyl, also made by W.W. Grainger, Part No. 6X156. The DPDT relay is a Part No PRA11AYA 1C-AUX 5A 120 VAC relay manufactured by Potter-Brumfield. The oil pump is a liquid feed 6.2 gallon capacity, W.W. Grainger oil pump, Part No. 1P679, Manufacturer No. 475C.

Figure 8:
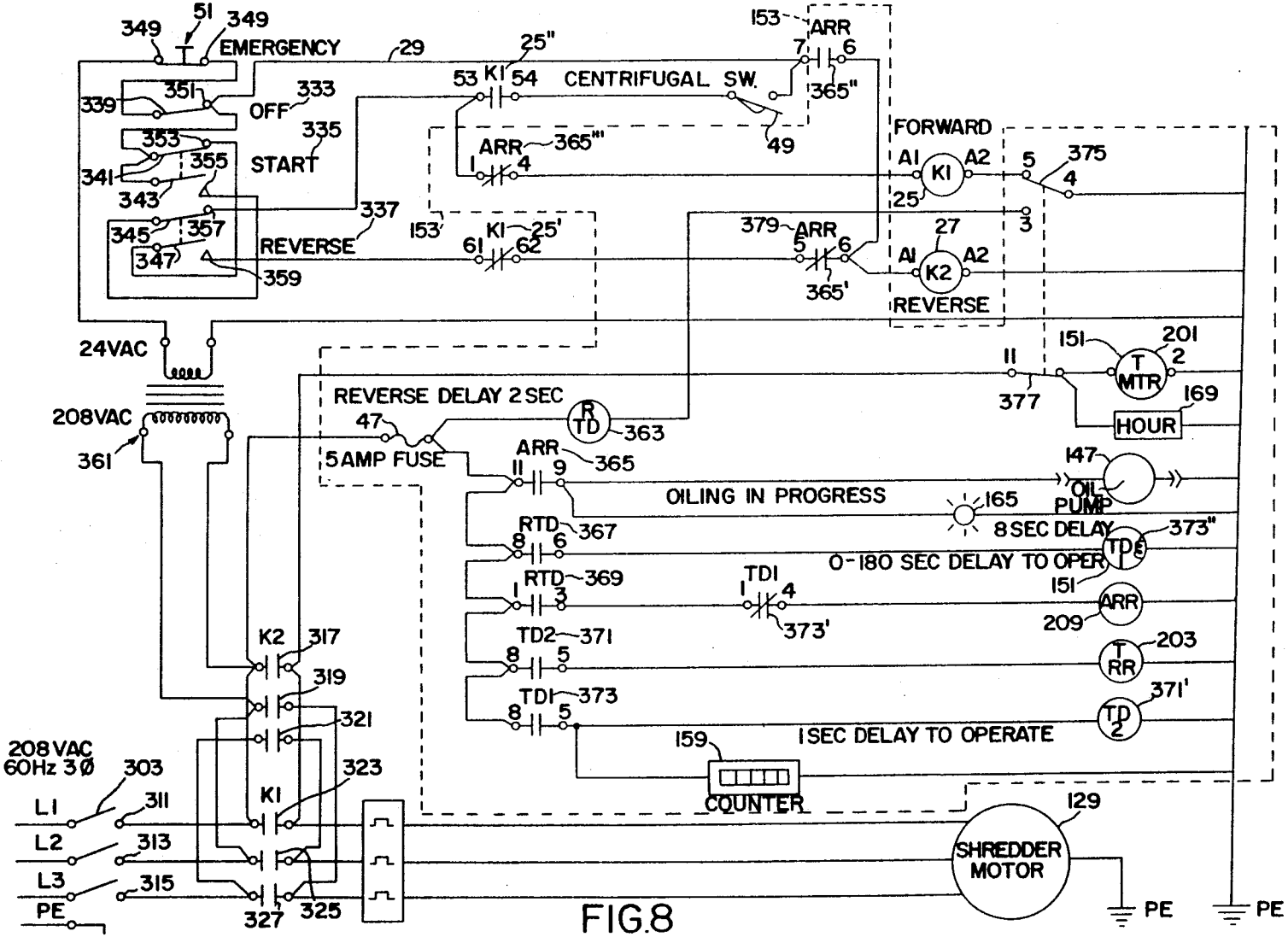
FIG. 8 is a partial schematic illustration of another control system for providing the sequence in the cycle illustrated in FIG. 4.

Referring now to FIG. 8, there is shown another embodiment of a control 29 for a standard motor 129. However, instead of changing phase, suitable switches are provided for the forward and reverse motion of motor 129. To this end, the motor switch 301 has armatures 303, 305 and 307, which have contacts 311, 313 and 315. Also, K2 connections 317, 319 and 321 are provided. In addition, K1 contacts 323, 325 and 327 are provided. Still further switch 51 has an emergency stop position 329, an off position 333, a start position 335 and a reverse position 337. To this end, suitable armatures 339, 341, 343, 345 and 347 are provided for contacts 349, 351, 353, 355, 357 and 359. Thus, the motor 129 is energized through transformer 361. As present in the particular shredders described, the control circuit 29 of FIG. 8 has a conventional fuse 47 and an overload switch 49. This completes the description of the existing shredder circuit to which the automatic oiler 147 of this invention is added.

It will be seen from FIG. 8 that the oiler pump 147 has a connection in sequencer 153 for the reverse rotation means 27. Still further, a counter 159 is provided for a completion of the cycle in the forward direction, including one oiling sequence. When the oil is in progress, the light 165 is lit. Furthermore, a conventional time delay relay, such as described in connection with the embodiment of FIG. 7, is provided. One suitable relay 373'' is provided with an eight second delay.

This is the sequencer 153 which has a conventional timer 155, such as is described above. This timer has an RTD reverse time delay relay 363 having a reverse delay of two seconds. The ARR relay 365 for the oil pump 147 is connected as shown in FIG. 8. Thus, there are provided an RTD relay 363, an ARR relay 365, an RTD relay 367, an RTD relay 369, a TD-2 relay 371 and a TD-1 relay 373. These relays are identified in the drawing of FIG. 8 in connection with the TD-2 relay 371', the TRR relay 203 and the ARR relay 209. Also, armatures 375 and 377 are provided for the K-1 forward relay 25 while another ARR switch 379 is provided for the K-2 reverse means 27.

The shredder motor 129 is energized by switch 51 in a conventional manner. In operation, this causes the timer 155 to begin accumulating a predetermined accumulated running time. This accumulated running time, which is advantageously about 30 minutes is set by an adjustment means 157 such as is illustrated in FIG. 4. The internal cams in the timer 155 transfer to two conventional microswitches (not shown in FIG. 8). One SPDT microswitch interrupts the normally forward rotation by breaking the K-1 relay 25 circuit and completes another circuit for the reverse time delay relay 363. This relay is a slow to operate device that is pre-set to two seconds before energizing. This delay insures that the three-phase drive motor 129 is powered by the K-1 connections to allow sufficient time to stop its rotation in the forward direction. Upon energizing the RTD relay 363, its contacts 1 and 3 close, sending power through the time delay relay contacts 1 and 4 to the coil of the automatic reverse relay 209. It energizes simultaneously with the RTD contacts 8 and 6, which close, placing the power to the coil of the TD-1 relay 373" and the ARR relay 209 contacts 7 and 6 to close. This directs power to the coil of the K-2 reverse relay 27. This action energizes the drive motor 129 in reverse rotation. The ARR relay 209 contacts 11 and 9 close, starting the oil pump 147 so that the cutter heads 13 and 15 receive lubrication. This cycle continues for eight seconds. Then the TD-1 coil 373" energizes the TD-1 contacts 1 and 4 to open. This causes the ARR relay 209 to drop out. Further, the ARR relay 209 contacts 5 and 6 open, removing power from the K-2 connection. This de-energizes the rotation of the drive motor 129. The ARR relay 209 contacts 11 and 9 open, stopping the oil pump operation. The TD-1 relay 373 contacts 8 and 6 close, placing power on the coil of the TD-2 contacts after a one-second delay to insure rotation of the drive motor has ceased. The TD-2 relay 371' picks up and the TD-2 contacts 8 and 6 close, putting power on the time re-set relay TRR 203. It energizes and simultaneously the TD-1 contacts 1 and 6 place power to the counter 159 to register that an oil cycle has occurred. The TRR relay 203, upon energizing, mechanically re-sets the timer assembly. Its internal switches transfer, contacts 3 to 4 change position and this opens contacts 3 and 4 and closes the appropriate contacts to re-arm the normally forward rotation circuitry. The timer contacts, which are disclosed in FIG. 7, reclose, arming the timing motor circuit and the hour meter circuit upon transfer of the timer contacts 3 to 4 to open. The circuit to the coil of the RTD relay 363 is opened and the RTD relay 363 relaxes its contacts 8 and 6 to their open position. This removes power from the TD-1 and RTD contacts 1 and 3 open to insure no power is available to the ARR coil. This removes power from the TD-1, which opens its contacts 8 and 6 and the TD-2 opens, dropping out the TRR relay 203. This returns the entire circuit to a new 30-minute time cycle. Upon completion of the automatic reverse and oiling cycle, the shredder 11 is ready for a new forward cutting operation, but in the interests of safety actual operation of the machine requires manual initiation through activation of the momentary start switch 51.

In operation, the off, start, reverse and emergency stop positions are as originally designed by the manufacturer of a conventional shredder. Control is in the hands of the machine operator. The automatic portion of the circuit is in a monitoring mode, which accumulates time during the cycle. Only on a time-out of the timer mechanism does the automatic reverse and oiling cycle influence the operation of the shredder 11.

For ease of explanation, the ARR and RTD contacts are labelled as shown in FIG. 8, but it will be understood by one skilled in the art that suitable modifications therein can be made within the scope of the claimed invention.

This invention has the advantage of providing an improved shredder. To this end, the reverse operation enables the cutters to rotate in the reverse mode to aid in purging waste paper residue from the :utter heads. During this cleaning of the cutter heads, the oil drops of this invention are applied to the cutting head surfaces to aid in reducing wear as a consequence of friction. Heretofore, the interval for the cleaning of the heads was once each hour. However, such an operation was far too cumbersome because it required too much down-time and maintenance. It also allowed the human factor to create a reduced longevity of the cutting heads, since the cleaning of the heads was frequently not applied for sufficient time or the heads were not cleaned evenly across the entire cutter surfaces. Also the heads were not lubricated properly. Thus, the automatic reverse and oiling feature of this invention were provided in the appropriate cycle and sequences.

This invention has the advantage of providing a combination with a paper shredder having a drive means coupled thereto for the forward and reverse motion thereof on command from a control means. This invention provides the improvement of an automatic oiler for lubricating the shredder in a predetermined cycle upon command, and command means for sequencing the control in an operational cycle for stopping the forward motion of the shredder by the drive means after a predetermined accumulated running time for reversing the motion of the shredder for the automatic oiling thereof for a predetermined time interval. Thus, this invention provides a method and apparatus for intermittently dropping oil on the cutting heads of the shredder for a predetermined time interval after the shredder is run for an accumulated time interval in the forward direction. Also, oiling is always done in the reverse direction for a suitable length of time. Thus, invention reduces the down-time and/or maintenance costs and increases the longevity of the shredder. Still further, the circuits provided by this invention maintain or improve the safety of the shredders known heretofore.

What is claimed:

1. In a paper shredder having a pair of counter-rotating shafts each mounting a plurality of spaced-apart disc-shaped cutters, drive means coupled to said shafts for reversible driving thereof and manual control means for controlling said driving means to selectively drive said shafts in a forward running direction or in a reverse clearing direction or to stop rotation of said shafts, automatic oiling means comprising:

timer means for timing a first timer interval corresponding to a predetermined accumulated time interval of forward driving of said shafts and a second time interval corresponding to a predetermined time interval of reverse driving of said shafts;

oil dispensing means disposed in spaced relation to said shafts and in operable communication with an oil pump and a supply of oil, for selectively oiling said plurality of cutters mounted on said shafts; and automatic sequence control means in operable connection with said manual control means, said timer means and said oil dispensing means, for causing said drive means to drive said shafts in a reverse direction after said first time interval has elapsed, said reverse driving of said shafts occurring during said second time interval, and for causing said oil pump to supply oil under pressure from said source of oil to said oil dispensing means to oil said cutters only during said reverse driving, and for causing said drive means to stop rotation of said shafts after said second time interval has elapsed.

2. The automatic oiling means of claim 1 wherein said oil dispensing means comprises a plurality of oil pipes disposed in parallel axial relation above said cutters, said oil pipes being each provided with a plurality of oiling holes arranged along the bottom thereof such that said oil under pressure is caused to drip from said oiling holes onto said cutters.

3. The automatic oiling means of claim 1 wherein said automatic sequence control means is operable to cause said oil pump to supply oil under pressure to said oil dispensing means after rotation of said shafts has been stopped and while said shafts are started to rotate in said reverse direction, whereby oil is caused to cling to said cutters until said shafts have completed at least one rotation so as to cause particles of oil to be spun up and around the surfaces of said cutters to cause the complete surfaces of said cutters to be oiled around the entire circumferences thereof.

4. The automatic oiling means of claim 1 wherein said first time interval is between fifteen and thirty minutes.

5. The automatic oiling means of claim 1 wherein said second time interval is eight seconds.

6. An automatic reversing and oiling apparatus for use in a paper shredder having a pair of counter-rotating shafts each mounting a plurality of spaced-apart disc-shaped cutters, drive means coupled to said shafts for reversible driving thereof, and manually operable control means for controlling said drive means to selectively drive said shafts in a forward running direction for shredding material admitted between said cutters thereof or in a reverse running direction for clearing shredded material from said cutters thereof or to stop rotation of said shafts, said automatic reversing and oiling apparatus comprising:

timer means for timing a first time interval of a predetermined accumulated running time of said shafts in said forward running direction thereof, and for timing a second time interval of predetermined running time of said shafts in said reverse running direction thereof;

oil dispensing means for selectively dispensing oil directly onto the said cutters of each of said shafts of said paper shredder; and automatic control means operably connectable with said manual control means of said paper shredder, said timer means and said oil dispensing means, for causing said drive means of said paper shredder, upon elapsing of said first time interval, to drive said shafts in said reverse running direction for said second time interval and for causing said oil dispensing means to dispense oil to said cutters only during said second time interval, and, upon elapsing of said second time interval, for causing said drive means to stop rotation of said shafts.

7. The automatic reversing and oiling apparatus according to claim 6, wherein said oil dispensing means comprises:

hollow elongate oil manifold means disposed parallel with and above said cutters and being provided with an oil inlet opening thereto and further being provided at intervals along an underside thereof with oil dispensing orifices for dispensing droplets of oil under pressure onto said cutters;

oil pump means operably communicable with the oil inlet of said oil manifold means for supplying oil under pressure thereto; and oil reservoir means operably communicable with said oil pump means for supplying oil thereto.

8. The automatic reversing and oiling apparatus according to claim 6, wherein said oil dispensing means comprises:

a pair of hollow elongate oil manifold means each disposed parallel with and above a respective one of said cutters and being each provided with an oil inlet opening thereto and further being each provided at intervals along an underside thereof with oil dispensing orifices for each dispensing droplets of oil under pressure onto a respective one of said cutters; and means operably communicable with the oil inlet of each said oil manifold means for supplying oil under pressure thereto.

9. An automatic cutting head lubricating apparatus for a paper shredder having a pair of reversible cutting heads, comprising:

means for accumulating a first predetermined time interval of running of said cutting heads in a forward paper shredding direction;

means for automatically stopping the forward running of said cutting heads upon elapsing of said first predetermined time interval;

means for automatically running said cutting heads in a reverse cleaning direction for a second predetermined time interval upon accumulation of said first predetermined time interval and said automatic stopping of said forward running of said cutting heads; and means for automatically applying lubricant onto said cutting heads only during said second predetermined time interval for completely wetting said cutting heads with lubricant.

10. The automatic cutting head lubricating apparatus of claim 9, wherein said first and second predetermined time intervals are of adjustable duration.

11. The automatic cutting head lubrication apparatus of claim 9, wherein said second predetermined time interval is of sufficient duration for permitting lubricant to be applied onto said cutting heads during at least one complete revolution thereof in said reverse running direction thereby causing the applied lubricant to cling to respective surfaces of said cutting heads and be spun up and around said surfaces for lubricating said cutting heads around entire circumferences thereof.

12. The automatic cutting head lubricating apparatus of claim 9, further comprising:

means for automatically stopping the reverse running of said cutter heads and said application of lubricant thereto and for resetting to zero the accumulation of said first predetermined time interval upon elapsing of said second predetermined time interval.

13. The automatic cutting head lubricating apparatus of claim 9, further comprising:

lockout means for maintaining said cutting heads stopped after elapsing of said second predetermined time interval until said paper shredder is manually restarted.

14. The automatic cutting head lubricating apparatus for claim 9, further comprising:

indicator means for indicating running of said second predetermined time interval.

15. The automatic cutting head lubricating apparatus of claim 9, wherein said means for automatically applying lubricant onto said reverse running cutting heads comprises:

oil pipe means provided above and in line with the respective axes of the cutting heads and provided with holes along respective undersides thereof for applying lubricating oil onto each of said cutting heads;

oil reservoir means for containing a supply of lubricating oil; and oil pump means in communication with said oil reservoir means and said oil pipe means and powered during said second predetermined time interval for forcing lubricating oil from said oil reservoir means through said oil pipe means thereby forcing the lubricating oil out said holes in said oil pipe means and directly onto knives of said cutting heads.

* * * * *